US005513455A

United States Patent [19]

Walker

[11] Patent Number: 5,513,455

[45] **Date of Patent: * May 7, 1996**

[54] THREE DIMENSIONAL MATTE-FRAME SYSTEM

[76] Inventor: Oscar Walker, 1923 Durkee Dr. West, Jacksonville, Fla. 32209

[ * ] Notice: The portion of the term of this patent subsequent to Dec. 4, 2011, has been disclaimed.

[21] Appl. No.: 985,864

[22] Filed: Dec. 4, 1992

[51] Int. Cl.[6] ..... G09F 1/12

[52] U.S. Cl. ..... 40/788; 40/298

[58] Field of Search ..... 40/152, 152.1, 40/155, 156, 539, 154

[56] References Cited

U.S. PATENT DOCUMENTS 2,772,499 12/1956 Ferrucci ..... 40/154
2,814,896 12/1957 Fujikawa ..... 40/155
2,950,556 8/1960 Larios ..... 40/154
4,870,766 10/1989 Topping ..... 40/143

FOREIGN PATENT DOCUMENTS 2220854 1/1990 United Kingdom ..... 40/152

*Primary Examiner*—Brian K. Green

[57] ABSTRACT

Three dimensional Matte-Frame System comprises a blank of flexible, bendable material generally having a rectangular picture carrying body; light weight; can be stacked and packed for carrying or shipping; will not require glue, nails or any other materials for assembly.

1 Claim, 2 Drawing Sheets

Fig. 5
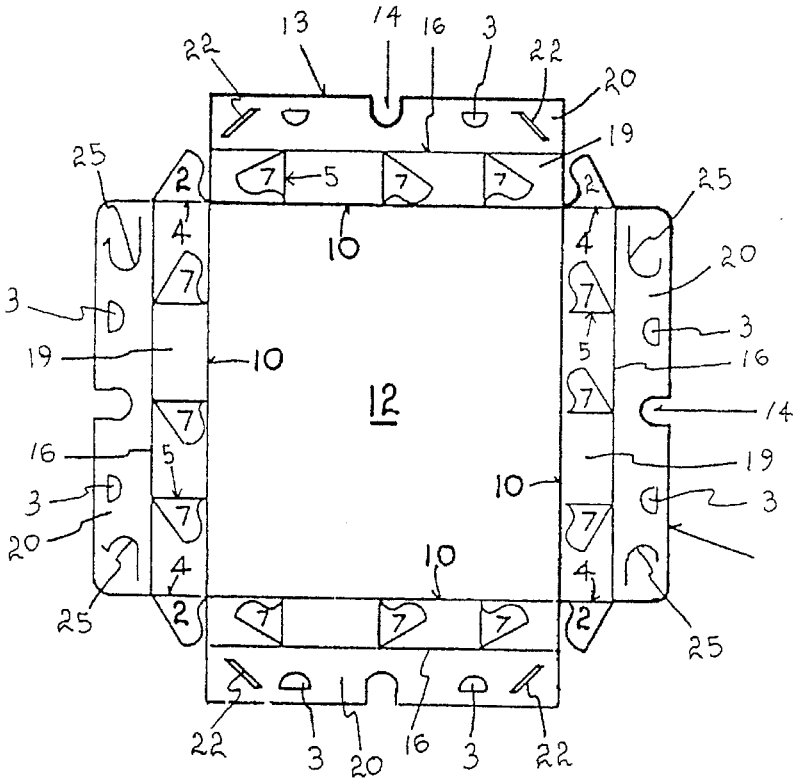
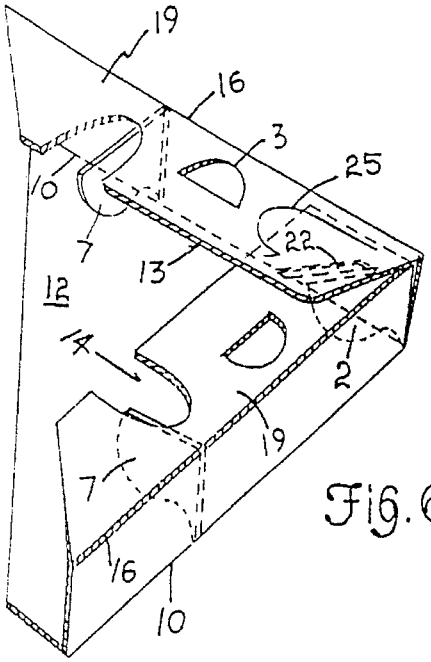
Fig. 6
Fig. 7
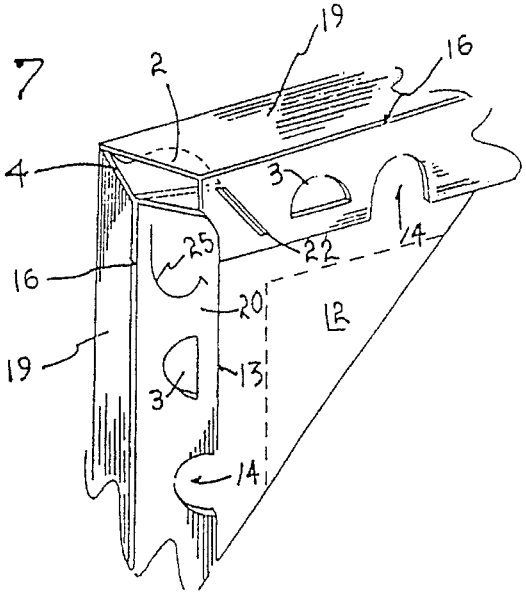

THREE DIMENSIONAL MATTE-FRAME SYSTEM

1. Technical Field: This invention relates to improvement in collapsible frame displays constructed of a pliable material such as cardboard, plastic and other similar materials; can be densely packed and shipped by the manufacture in collapsible form and may thereafter be easily assembled for display.

2. Background Art: Inventor Earl M. Roach, Chicago, Ill., assignor to Arvey Corporation presented a collapsible display embodying a central panel having integral side pieces forming a beveled hollow frame. See document 2-408-532; patented Oct. 1, 1946; Class 40; and Subclass 155. See Schedule A enclosed.

SUMMARY OF THE INVENTION

The primary objective of my invention is to provide a 12 collapsible display constructed of a pliable foldable material. Further, when in set-up position said display can function separately and equitably as a picture matte, picture frame, combination Matte and Frame without changing said invention's embodiment or structural characteristics.

Further, another objective is to provide a display with a solid central panel having a calendared surface that provides for the application of paints, inks, and other art media application.

Further, another objective is to provide a display that will not require any preassembling by the manufacturer and can easily and quickly be set-up without the need of glue, nails, staplers or other fastening materials.

Still another objective is to provide a display that can be quickly and easily disassembled for storing or carrying.

Other and subordinate objectives of my invention all together with the precise details and construction improvements will be readily understood upon consideration of the following specification in the drawings:

BRIEF DESCRIPTION OF THE DRAWINGS

FIG. 5 is a blank development of the preferred embodiment illustrated in preceding figures, and viewed from the rear thereof.

FIG. 6 is a relatively enlarged show through fragmentary view in perspective illustrating partial set-up position and locking parts viewed from the rear thereof.

FIG. 7 is a relatively enlarged fragmentary detail in perspective illustrating partial set-up position viewed from the rear thereof.

DESCRIPTION OF THE PREFERRED EMBODIMENT

Figure 1:
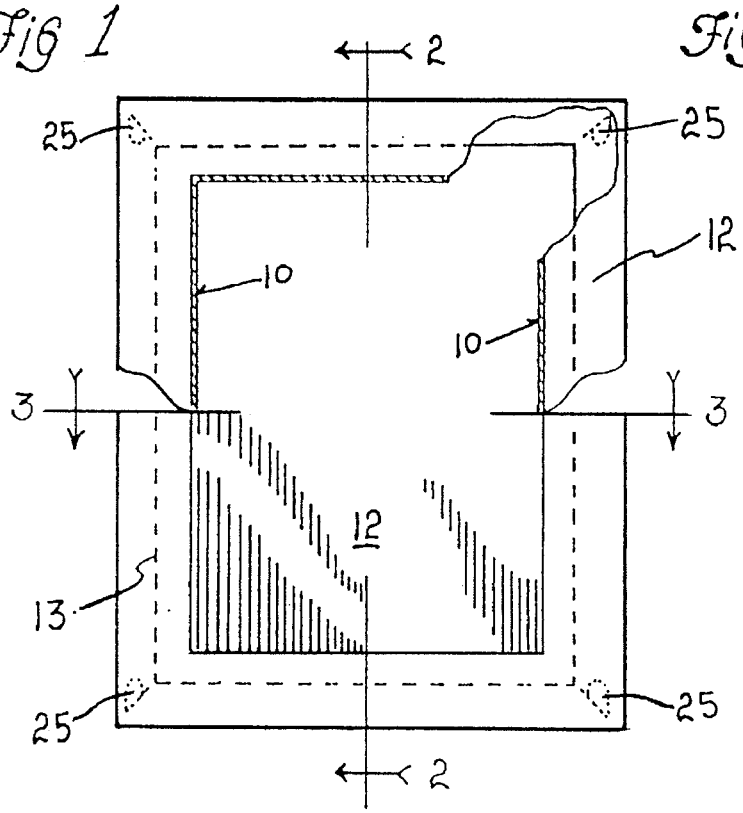
FIG. 1 is a view of the preferred embodiment with parts broken away presenting both a solid and cutaway view of the central panel.
Figure 2:
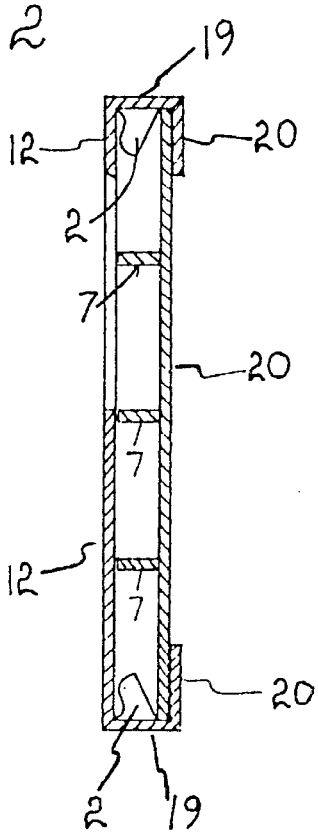
FIG. 2 is a section of the line 2—2 of FIG. 1.
Figure 3:
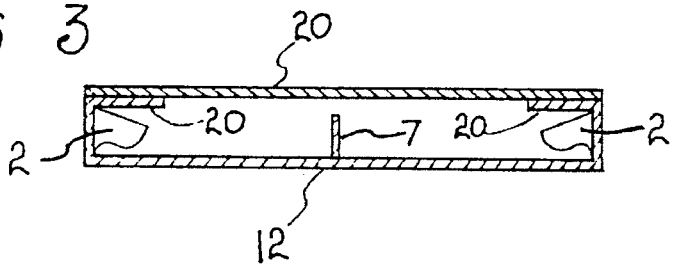
FIG. 3 is a section of the line 3—3 of FIG. 1.
Figure 4:
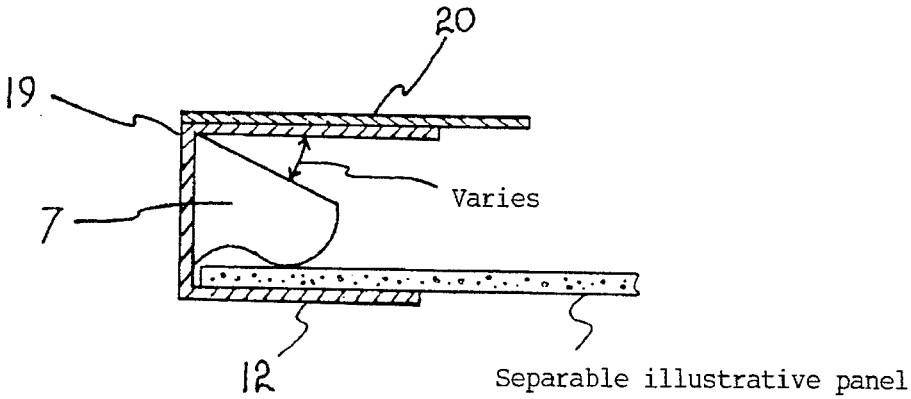
FIG. 4 is a relatively enlarged fragmentary view in section taken on line 3—3 of FIG. 1 which illustrates the locking position of fill-tab (7) in embracing and holding engagement with separable panel.

Referring to the drawings, my collapsible Matte-Frame display comprises a foldable sheet stock usually in quadrilateral form such as illustrated in FIG. 5, scoured on lines 10 to define a central panel 12 and side pieces generally indicated as 13. Each said side pieces 13 are provided with a fold line as at 16, forming outermost side panels 20 and innermost side panels 19 contiguous with the central panel 12; having first opposing outermost panels provided with a pair of latching tongues 25 spaced inwardly from said first opposing outermost panels rectangular ends; having second opposing outermost panels provided with a pair of latching slots 22 spaced inwardly from said second opposing outermost panels rectangular ends; having said first and second opposing innermost panels fold at line 10 adjacent to the plane of the central panel; having said first and second opposing outermost panels fold at line 16 in a bent rearward return direction substantially overlapping the central panel, thus, engaging said latching tongues and said latching slots to unite into locking embrace thereby holding the framing body into sit-up position.

Each of the outermost panels 20 are provided with hang-holes 3 and hang-pivots 14, thus, when said framing body is in set-up position either said hang-holes or said hang-pivots can be used to suspend said framing body in a balanced vertical or horizontal aiming direction. 19

Having first opposing innermost panels 19 provided with primary fill-tabs 2 adjoined thereto by fold lines 4 extending outwardly therefrom the width of said first opposing innermost panels.

Each of the innermost panels 19 are provided with secondary fill-tabs 7 attached thereto by fold lines 5, thus, when the framing body is in set-up position, said fill-tabs will project perpendicular to the rearward plane of panels 19 substantially overlapping and engaging a separable illustrative picture equal in area to the central panel into firm pressed relationship.

Having described my invention, what I claim as new and desired to secure by letters patent of the U.S. is:

1. A picture matte-frame structure comprising a singe flat blank made of a flexible sheet stock; the flat blank including: a central panel having four sides, four side pieces attached to the central panel, one of the side pieces being attached to each one of the four sides along a first fold line, each of the side pieces including a second fold line which divides each of the side pieces into an outermost side panel and an innermost side panel, each of the innermost side panels having a plurality of primary fill-tabs which are generally thumb-shaped, each of the outermost side panels having a plurality of hang-holes therein, each of the outermost panels having a hang-pivot therein, two of said outermost panels including a plurality of latching tongues, and two of said outermost panels including a plurality of latching slots therein.

* * * * *